US008786503B2

(12) United States Patent
Apostolos et al.

(10) Patent No.: US 8,786,503 B2
(45) Date of Patent: Jul. 22, 2014

(54) DUAL UHF DIPOLE QUADRAFILER HELIX ANTENNA

(75) Inventors: John T. Apostolos, Lyndeborough, NH (US); Benjamin G. McMahon, Keene, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 208 days.

(21) Appl. No.: 13/473,723

(22) Filed: May 17, 2012

(65) Prior Publication Data

US 2013/0009832 A1 Jan. 10, 2013

Related U.S. Application Data

(60) Provisional application No. 61/505,141, filed on Jul. 7, 2011.

(51) Int. Cl.

| | |
|---|---|
| ***H01Q 1/00*** | (2006.01) |
| ***H01Q 21/00*** | (2006.01) |
| ***H01Q 1/27*** | (2006.01) |
| ***H01Q 21/10*** | (2006.01) |
| ***H01Q 5/00*** | (2006.01) |
| ***H01Q 11/08*** | (2006.01) |
| ***H01Q 9/22*** | (2006.01) |
| ***H01Q 1/32*** | (2006.01) |

(52) U.S. Cl.

CPC ..... *H01Q 1/273* (2013.01); *H01Q 21/10* (2013.01); *H01Q 5/0093* (2013.01); *H01Q 11/08* (2013.01); *H01Q 9/22* (2013.01); *H01Q 1/3275* (2013.01); *H01Q 5/0072* (2013.01)

USPC ..... 343/730; 343/727

(58) Field of Classification Search

CPC ..... H01Q 21/30; H01Q 21/29; H01Q 21/24; H01Q 21/00; H01Q 9/16; H01Q 25/00; H01Q 1/273; H01Q 5/0072; H01Q 11/08; H01Q 21/10

USPC ..... 343/725, 727, 792, 730

See application file for complete search history.

(56) References Cited

U.S. PATENT DOCUMENTS

| | | | | |
|---|---|---|---|---|
| 2,987,721 | A * | 6/1961 | Edwards et al. | 343/725 |
| 6,483,471 | B1 * | 11/2002 | Petros | 343/725 |
| 7,339,542 | B2 * | 3/2008 | Lalezari | 343/773 |
| 7,589,694 | B2 * | 9/2009 | Martek et al. | 343/895 |

* cited by examiner

*Primary Examiner* — Hoang V Nguyen
(74) *Attorney, Agent, or Firm* — Daniel J. Long

(57) ABSTRACT

A dual purpose antenna is provided with the UHF antenna in the form of a pair of copper tubes to provide an off center fed dipole, with a pair of quadrafiler helix L1 and L2 GPS antennas stacked on top of the UHF antenna, and with the top section of the UHF dipole providing a ground plain for the GPS antenna. The antennas are fed internally by two coaxial feeds, one feeding the UHF antenna, the other passing through the UHF antenna to feed the GPS antennas. In one embodiment, a tuning coil is provided at the base of the UHF antenna by the coiling of the two coaxial feeds around a non-conductive mandrel, with copper taping placed on top of the coiled coaxial sections to provide an LC circuit to lower the resonant frequency of the UHF antenna to 225 MHz.

20 Claims, 5 Drawing Sheets

DUAL UHF DIPOLE QUADRAFILER HELIX ANTENNA

RELATED APPLICATIONS

This application claims rights under 35 USC §119 (e) from U.S. Application Ser. No. 61/505,141 filed Jul. 7, 2011, the contents of which are incorporate herein by reference.

STATEMENT OF GOVERNMENT INTEREST

The invention was made with United States Government assistance under contract no. SUGV W56 HZV-05-C-0724/5EC8385 awarded by the US Army. The United States Government has certain rights in the invention.

FIELD OF THE INVENTION

This invention relates to UHF antennas and more particularly to a dual dipole/GPS antenna structure.

BACKGROUND OF THE INVENTION

For systems that require ultra high frequency (UHF) and GPS communications, generally separate GPS antennas and UHF communication antennas are needed. Using two separate antennas in these cases is not a cost effective use of space on any platform. Particularly, small unmanned ground vehicles (SUGV), unmanned aerial vehicles, micro unmanned aerial vehicles, and soldier back pack applications are systems where antenna space is limited and antenna placement is important. A need therefore exists for an antenna design that minimizes antenna space on systems without impacting antenna performance.

More particularly robot vehicles have a requirement to communicate with base stations using UHF band communications. These vehicles also need to report back to the base station their exact location. While it might be thought that GPS L band antennas could be used both for geophysical location and communications, the L band antennas do not work for communications purposes especially in the UHF band. There is therefore a need for a low profile efficient dipole antenna that has its center some distance above the ground for propagation purposes while at the same time supporting GPS functionality.

In addition to the robot applications and applications involving the signaling of position of mobile devices such as remotely controlled vehicles and the like, as well as communicating with these devices, there is also a need for providing precise GPS timing signals to a class of transceivers termed Joint Tactical Radio System (JTRS) radios. In these applications it is not so much the requirement to be able to receive GPS signals for geo-location purposes, rather it is the functionality of such JTRS radios which are in essence software-defined radios. In order for software-defined radios to operate one has to have precise timing signals. This timing is provided in one embodiment through the detection of GPS timing signals both in the L1 and L2 bands, with the timing signals being especially important for the cyber encryption/decryption systems that are utilized with these radios.

Regardless, what is required is a low profile antenna to replace the monopoles in the form of rubber duck types of antennas with an increased gain UHF bands antenna as well as to provide extra height for the antenna. Additionally for JTRS radios they are often times located in backpacks. It is thus important to provide a low profile antenna that has been optimized for use with the new JTRS radios as well as providing these radios with GPS waveform timing signals.

It is noted that the two timing signals that are available from the L1 and L2 bands are required for the precision timing, specifically for crypto applications. In fact, many of the software-defined radios of the JTRS variety are architected to time their waveforms with timing signals from the L1 and L2 bands GPS signals.

There is therefore a necessity to provide a combined UHF/GPS antenna with a stiff but spring loaded housing and to provide the antenna with good UHF propagation characteristics to achieve ranges unattainable by rubber duck type antennas. It is also important to be able to provide the antenna with a sufficient flexibility so that if it contacts a stationary object, the vehicle to which it is mounted is not overturned or alternatively that the antenna is not itself damaged.

In terms of the operating range for such an antenna it would be desirable to have an operating range between 225 MHz and 400 MHz for the UHF antenna, with the two GPS antennas operating in the gigahertz L1 and L2 bands.

SUMMARY OF THE INVENTION

To solve the above problems, a combined dual UHF/GPS antenna is provided in which an off center fed UHF tubular dipole is spring loaded at the base and is topped with a stacked pair of quadrafiler helix antennas for the L1 band and L2 band respectively.

The feedlines for the antennas are fed through the tubes making up the UHF dipole, with a lower coaxial feed line feeding the off center fed dipole such that the inner conductor of the lower coaxial feedline feeds the lower section of the dipole and the outer conductor feeds the upper section of the dipole.

The upper coaxial feedline runs up through the center of the dipole which is in one embodiment made of tubular copper, and is coupled to the upper antenna section that carries the GPS antennas. The L1 and L2 bands are separated by a diplexer which is then connected to separate low noise amplifiers that are in turn connected to the helices of two quadrafiler high helix antenna sections, one for the L1 band and the other for the L2 band.

In order to lower the resonance frequency of the UHF antenna, in one embodiment the two coaxial feedlines which extend from the bottom of the UHF antenna are coiled together on an insulating mandrel, with a number of turns overlain with copper tape to provide an LC circuit to lower the operating frequency of the UHF antenna. The tape forms a capacitive strip coupled to the coils to provide a circuit that resonates close to 225 MHz, with the capacitive coupling of the tape over the turns capacitively coupling the turns together. By introducing more capacitance between the turns, the effect is to lower the resonant frequency of the UHF antenna.

The net result is that the two sets of antennas can operate independently of each other without interference, with the coils and tape lowering the resonant frequency of the UHF antenna. In one embodiment the center frequency of the UHF antenna is designed to be 300 MHz to give the UHF antenna a bandwidth between 225 and 400 MHz.

It is noted that in one embodiment the upper coaxial feedline passes through the lower antenna section without affecting the operation of the lower antenna section. In one embodiment the LC circuit at the base of the antenna is made up of seven turns of upper and lower coaxial feedlines around a non-conductive mandrel at the base of dipole.

Noting that the entire antenna structure is rigid, a spring is fixed to the base of the dipole to provide the required flexibility.

In summary, a dual purpose antenna is provided with the UHF antenna in the form of a pair of copper tubes to provide an off center fed dipole, with a pair of quadrafiler helix L1 and L2 GPS antennas stacked on top of the UHF antenna, and with the top section of the UHF dipole providing a ground plain for the GPS antenna. The antennas are fed internally by two coaxial feeds, one feeding the UHF antenna, the other passing through the UHF antenna to feed the GPS antennas. In one embodiment, a tuning coil is provided at the base of the UHF antenna by the coiling of the two coaxial feeds around a non-conductive mandrel, with copper taping placed on top of the coiled coaxial sections to provide an LC circuit to lower the resonant frequency of the UHF antenna to 225 MHz.

BRIEF DESCRIPTION OF THE DRAWINGS

These and other features of the subject invention will be better understood in connection with the Detailed Description, in conjunction with the Drawings, of which.

DETAILED DESCRIPTION

Figure 1:
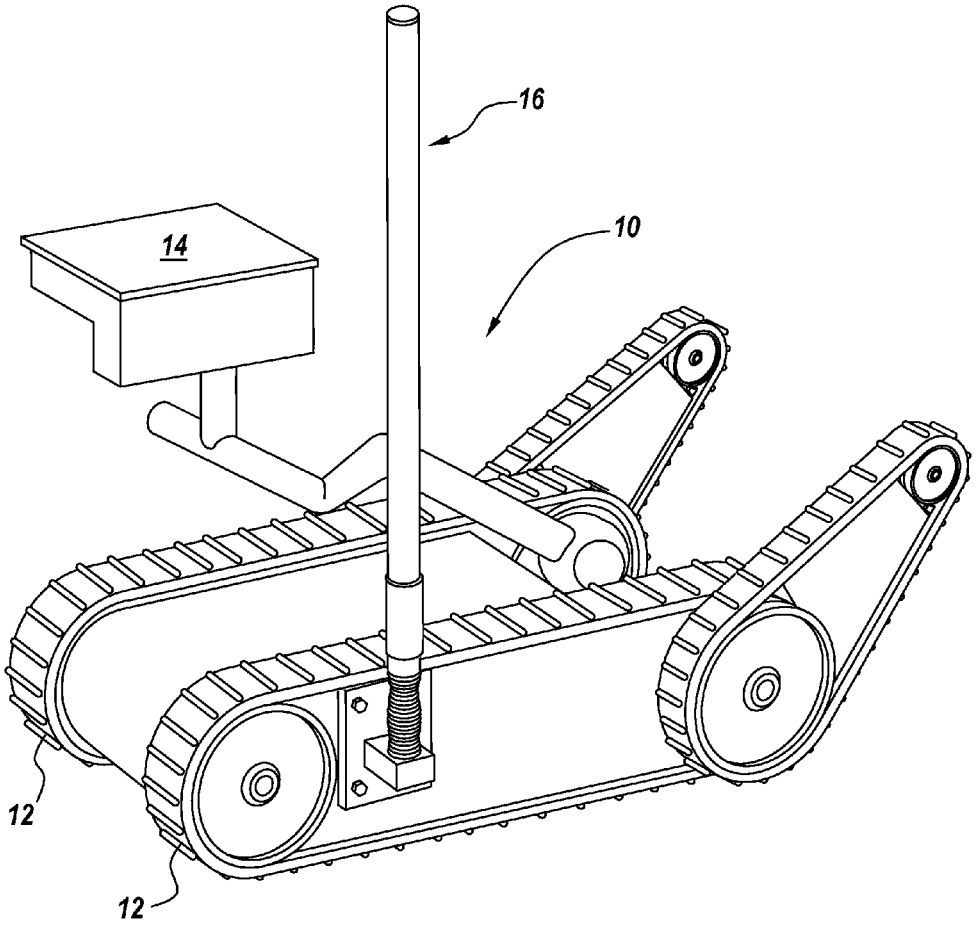
FIG. 1 is a diagrammatic representation of a robot provided with the subject antenna.

Referring now to FIG. 1, what is shown is a robot 10 having treads 12 and an electronics package 14 that carries a transceiver and GPS receiver. It is the purpose of the transceiver to provide signaling to and from the robot at UHF frequencies. A dual purpose antenna 16 has a UHF section and a pair of quadrofiler helix GPS antennas stacked on top. The GPS antenna is to provide both timing signals for the transceiver as well as to provide geolocation signals so that the robot can be extremely accurately located.

As mentioned above, because the amount of real estate on the robot is relatively small, dual purpose antenna 16 is provided with a UHF band antenna and a pair of GPS antennas to provide for the aforementioned signals. It will be appreciated that such an antenna is relatively short not exceeding 22 inches and as such constitutes a low profile antenna.

Before going into the antenna design, the subject antenna is shown mounted to a backpack-carried radio in FIGS. 4 and 5 in which the backpack is illustrated by reference character 20, whereas the antenna extends upwardly from the backpack as illustrated at 16 in FIG. 4.

Figure 4:
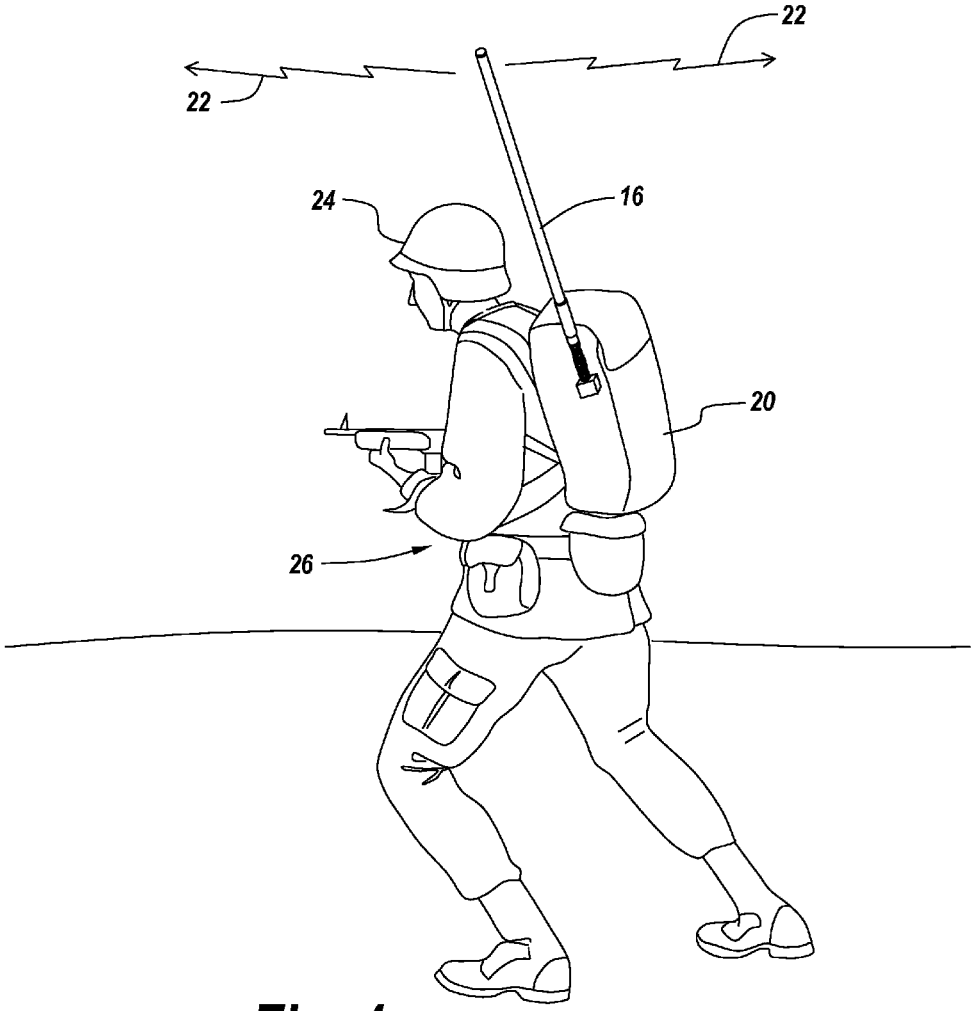
FIG. 4 is a diagrammatic illustration of a soldier with a backpack-carried radio using the subject antenna in a vertical orientation; and, FIG. 5 is a diagrammatic illustration of the soldier of FIG. 4 in a prone position, with the antenna horizontal.
Figure 5:
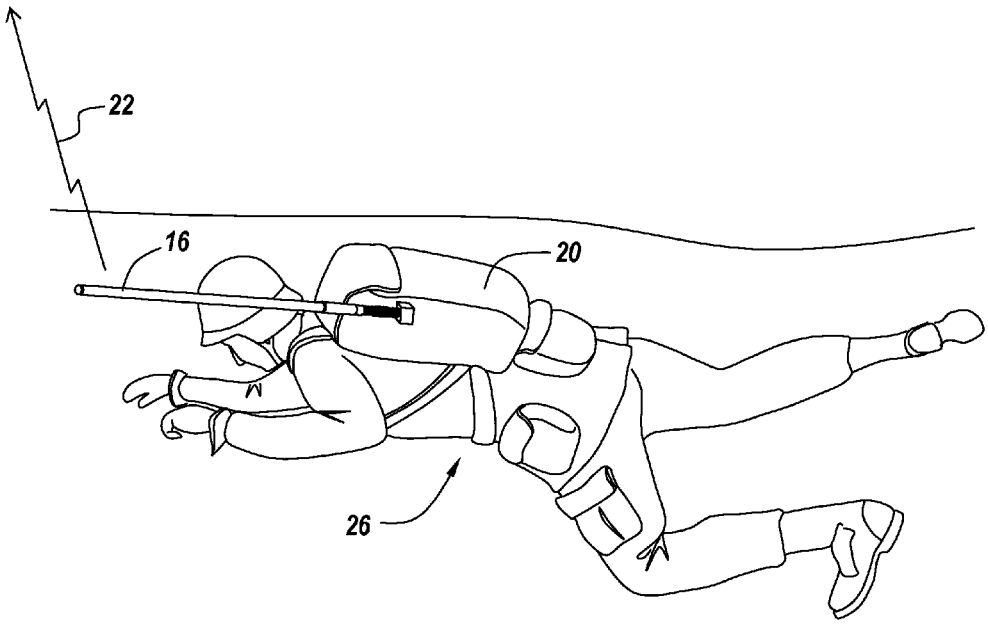

As can be seen in FIGS. 4 and 5 the visibility of a dual functioning antenna at a recipient site is such that signal from antenna 16 can achieve a significant range as indicated by signal arrow 22 in either the forward or reverse directions, due to the extension of the antenna above the head 24 of soldier 26.

As illustrated in FIG. 5, with the soldier lying down on his face as illustrated, antenna 16 is still visible at remote recipient sites as illustrated by signal arrow 22.

It will be seen that the gain of the subject antenna is sufficient to provide adequate range from a large number of orientations and is not blocked by the individual carrying the backpack.

Figure 2:
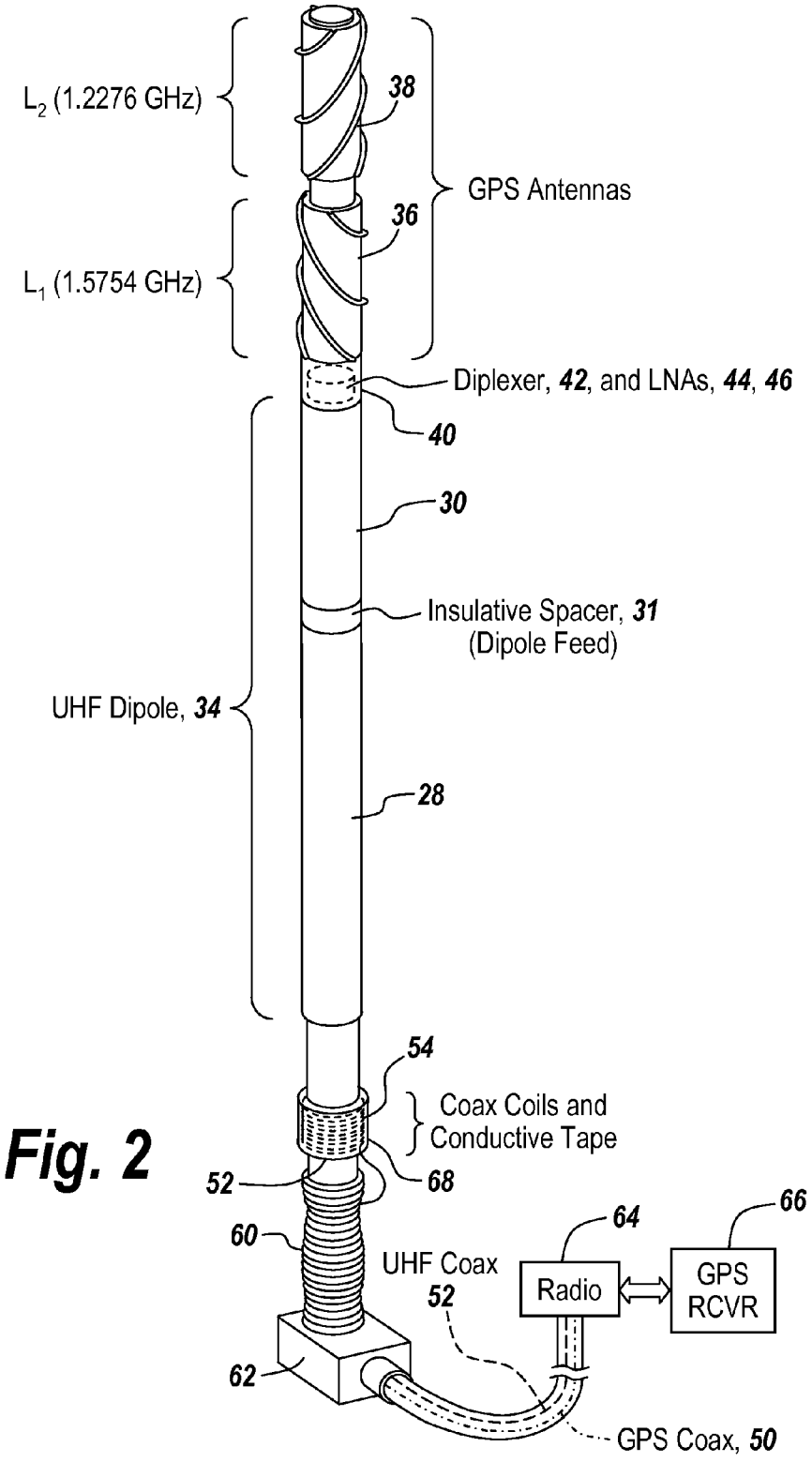
FIG. 2 is a diagrammatic representation of the subject antenna showing the UHF and GPS sections stacked on top of each other.
Figure 3:
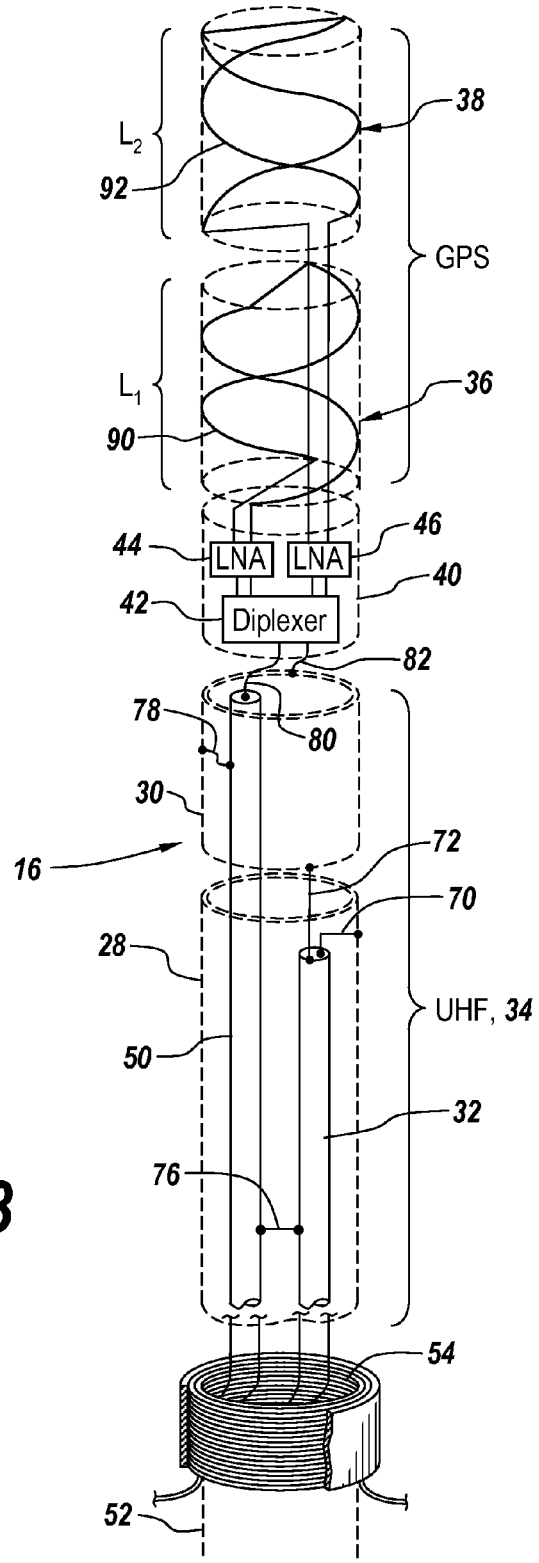
FIG. 3 is an exploded and diagrammatic illustration of the antenna of FIG. 2 showing the dual coaxial feed of the antennas running through the tubular UHF dipole as well as to the diplexer feed to the L1 and L2 GPS antennas.

Referring to FIG. 2, antenna 16 is shown spaced by an insulating ring spacer 31 and is comprised of an off center fed dipole in the form of cylindrical tubes or sleeves 28 and 30 which as will be discussed are fed by a lower coax feed line 32. These two tube sections form a UHF dipole 34, whereas quadrafiler helix antennas 36 and 38 operates in the L1 and L2 bands are stacked above the UHF dipole and aligned therewith. In between the top of UHF dipole section 30 and the bottom of the L1 quadrafiler helix antenna 36 is a spacer 40 which houses a diplexer 42 and a pair of low noise amplifiers 44 and 46 that split up the signals from the L1 and L2 antennas. These signals are then combined at the diplexer and connected to the bottom of the antenna through the second of the coaxial cables 50 which runs through the UHF antenna dipole to the base.

The two coaxial feeds for this antenna come out of the base of UHF dipole element 28 and are coiled over an insulating mandrel 52 such that the coax is coiled as illustrated at 54 around the mandrel, with the two coaxial cables running side by side. These two coax cables run out through a spring assembly 60 and through a bracket 62 such that the UHF coax 32 is coupled to a radio 64 and such that the coaxial cable 50 from the GPS antenna here is connected to radio 64 and thence to a GPS receiver 66. It will be noted that the L1 frequency is 1.5754 gigahertz, whereas the L2 frequency is 1.2276 gigahertz. Assuming that the UHF antenna and the GPS antenna are appropriately fed by the associated two coaxial cables and assuming that the operation of the UHF antenna dipole does not interfere with the operation of the GPS antennas and visa versa, then what one has is a low profile rigid antenna mounted on a spring which is usable for unmanned vehicles or JTRS radios so as to provide the communications necessary for these radios.

It will be appreciated that in order to provide for the aforementioned tuning, the coiled together coaxial cables at the base of the antenna are provided with conductive tape 68 which overlies the cables and provides a capacitive coupling between the cables. This capacitive coupling is such that the lower frequency of the UHF dipole is extended downwardly to 225 MHz.

Referring to FIG. 4, in which like elements carry like reference characters, it will be seen that UHF coax 32 has its center conductor 70 coupled to lower section of the dipole as illustrated. The braid of coax 32 is electrically coupled to the upper portion of the dipole 30 as illustrated at 72.

It will also be seen that the GPS coaxial cable 50 runs up through the center of the UHF dipole, with the outer braid of the two coaxial cables connected together and bonded as illustrated at 76. Note also that the outer shield of coaxial cable 50 is also bonded to the upper section 30 of the UHF dipole as illustrated at 78.

The center conductor of coaxial cable 50, here illustrated at 80, is connected to diplexer 42 and also to the upper dipole element 30 as illustrated at 82. Thereafter, a pair of low noise amplifiers 44 and 46 are coupled to diplexer 42 and to the helical coils 90 and 92 of GPS antennas 26 and 38.

The net result is that the subject low profile antenna provides a unitary package for the UHF antenna and the GPS antennas, with the GPS antennas stacked on the top of the UHF antenna for better visibility to the satellites.

It has been found that with a two inch tape over coils 54 the antenna has a gain of 3 dBi between 220 and 400 MHz, with an SWR in the 2.5:1 range.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A dual UHF/GPS antenna system comprising:

a UHF dipole antenna structure comprising an upper tubular section and a lower tubular section;

a lower coaxial feedline wherein the outer conductor of the lower coaxial feedline is configured to feed the upper section of the dipole antenna structure and the inner conductor of the lower coaxial feedline is configured to feed the lower section of the dipole antenna structure;

an upper coaxial feed line configured to access the upper section through the lower section of the dipole antenna structure, said coaxial feedlines coiled at the bottom of said lower section of said dual dipole structure and overlain with a strip of conductive tape; and a GPS antenna stacked on top of said dipole antenna structure and fed with the upper coaxial feedline, wherein said GPS antenna includes a stacked pair of L1 and L2 band GPS antennas.

2. The antenna system of claim 1, wherein the upper section of the dipole antenna structure includes said GPS antenna.

3. The antenna system of claim 1, wherein the upper coaxial feedline passes through the lower section without affecting the operation of the lower section of the dipole antenna structure.

4. The antenna system of claim 1, wherein the coil includes at least seven turns of the upper and lower coaxial feedlines around a nonconductive part of the dipole antenna structure.

5. The antenna system of claim 1, further including a spring structure fixed to the base of the dipole antenna structure.

6. The antenna system of claim 1, wherein said coiled coaxial feedlines and said strip form an LC circuit for lowering the operating frequency of said dipole.

7. The antenna system of claim 6, where said dipole is tuned to the center of the UHF band at 300 MHz.

8. The antenna system of claim 7, wherein the lower end of the UHF band at which said dipole operates is 225 MHz.

9. The antenna system of claim 1, wherein said GPS antennas include quadrofiler helix antennas.

10. The antenna system of claim 1, and further including a diplexer and low noise amplifiers interposed between the end of said upper coaxial feedline and said L1 and L2 band GPS antennas.

11. The antenna system of claim 1, wherein the upper section of said dipole antenna structure serves as a ground plane for said GPS antenna.

12. A dual UHF/GPS antenna system comprising:

a UHF dipole antenna structure comprising an upper tubular section and a lower tubular section;

a lower coaxial feedline wherein the outer conductor of the lower coaxial feedline is configured to feed the upper section of the dipole antenna structure and the inner conductor of the lower coaxial feedline is configured to feed the lower section of the dipole antenna structure;

an upper coaxial feed line configured to access the upper section through the lower section of the dipole antenna structure, and a GPS antenna stacked on top of said dipole antenna structure and fed with the upper coaxial feedline, said GPS antenna having said upper tubular section as a ground plane, wherein there is a coil which include at least seven turns of the upper and lower coaxial feedlines around a nonconductive part of the dipole antenna structure.

13. The antenna system of claim 12, wherein the said coaxial feedlines are coiled at the bottom of said dipole structure.

14. The antenna system of claim 13, and further including a strip of conductive tape over said coiled feedlines.

15. The antenna system of claim 14, wherein said coiled coaxial feedlines and said strip form an LC circuit for lowering the operating frequency of said dipole.

16. The antenna system of claim 15, where said dipole is tuned to the center of the UHF band at 300 MHz.

17. The antenna system of claim 16, wherein the lower end of the UHF band at which said dipole operates is 225 MHz.

18. A dual UHF/GPS antenna system comprising:

a UHF dipole antenna structure comprising an upper tubular section and a lower tubular section;

a lower coaxial feedline wherein the outer conductor of the lower coaxial feedline is configured to feed the upper section of the dipole antenna structure and the inner conductor of the lower coaxial feedline is configured to feed the lower section of the dipole antenna structure;

an upper coaxial feed line configured to access the upper section through the lower section of the dipole antenna structure, said coaxial feedlines coiled at the bottom of said lower section of said dual dipole structure and overlain with a strip of conductive tape, wherein there is a coil which includes at least seven turns of the upper and lower coaxial feedlines around a nonconductive part of the dipole antenna structure; and a GPS antenna stacked on top of said dipole antenna structure and fed with the upper coaxial feedline.

19. A dual UHF/GPS antenna system comprising:

a UHF dipole antenna structure comprising an upper tubular section and a lower tubular section;

a lower coaxial feedline wherein the outer conductor of the lower coaxial feedline is configured to feed the upper section of the dipole antenna structure and the inner conductor of the lower coaxial feedline is configured to feed the lower section of the dipole antenna structure;

an upper coaxial feed line configured to access the upper section through the lower section of the dipole antenna structure, said coaxial feedlines coiled at the bottom of said lower section of said dual dipole structure and overlain with a strip of conductive tape; and a GPS antenna stacked on top of said dipole antenna structure and fed with the upper coaxial feedline, wherein said coiled coaxial feedlines and said strip form an LC circuit for lowering the operating frequency of said dipole.

20. A dual UHF/GPS antenna system comprising:

a UHF dipole antenna structure comprising an upper tubular section and a lower tubular section;

a lower coaxial feedline wherein the outer conductor of the lower coaxial feedline is configured to feed the upper section of the dipole antenna structure and the inner conductor of the lower coaxial feedline is configured to feed the lower section of the dipole antenna structure;

an upper coaxial feed line configured to access the upper section through the lower section of the dipole antenna structure, said coaxial feedlines coiled at the bottom of said lower section of said dual dipole structure and overlain with a strip of conductive tape; and a GPS antenna stacked on top of said dipole antenna structure and fed with the upper coaxial feedline, wherein the upper section of said dipole antenna structure serves as a ground plane for said GPS antenna.

* * * * *